US005510590A

United States Patent [19]

Hux

[11] Patent Number: 5,510,590

[45] Date of Patent: Apr. 23, 1996

[54] MULTIPOLE SWITCH WITH COMMON POLYPHASE OPERATING MECHANISM CHARACTERIZED BY STAGGERED CONNECTION OR DISCONNECTION

[75] Inventor: Guido Hux, Unterentfelden, Switzerland

[73] Assignee: GEC Alsthom T&D AG, Oberentfelden, Switzerland

[21] Appl. No.: 352,115

[22] Filed: Dec. 1, 1994

[30] Foreign Application Priority Data

Jan. 12, 1994 [EP] European Pat. Off. ..... 94100349

[51] Int. Cl.[6] ..... H01H 33/42

[52] U.S. Cl. ..... 218/6; 218/7; 218/153

[58] Field of Search ..... 218/2, 5, 7, 44, 218/58, 68, 71, 78, 84, 92, 153, 154, 6

[56] References Cited

U.S. PATENT DOCUMENTS

| | | | |
|---|---|---|---|
| 3,025,375 | 3/1962 | Frank | 218/71 |
| 3,632,929 | 1/1972 | Butler | 218/4 |
| 4,612,428 | 9/1986 | Nicoloso | 218/43 |
| 4,814,560 | 3/1989 | Akesson | 218/84 |
| 5,107,081 | 4/1992 | Aoyama et al. | 218/84 |
| 5,128,502 | 7/1992 | Hux | 218/153 |

FOREIGN PATENT DOCUMENTS

| | | | |
|---|---|---|---|
| 0541078 | 5/1993 | European Pat. Off. | H01H 33/02 |
| 3810453 | 10/1988 | Germany | H01H 33/44 |

*Primary Examiner*—J. R. Scott

*Attorney, Agent, or Firm*—Jacobson, Price, Holman & Stern

[57] ABSTRACT

Each interrupter unit (10, 12, 14) of the switch for medium voltage and high voltage has a drive shaft (30), a moving switch contact piece (18) and a transmission linkage (38) which connects the switch contact piece (18) to the drive shaft (30). All the interrupter units (10, 12, 14) are of identical construction. A drive lever (40) is seated in a rotationally fixed manner on each drive shaft (30), which drive levers (40) are connected to one another via connecting rods (44, 46). In order to bring about staggered switching, the drive levers (40) of at least two interrupter units (10, 12, 14) are arranged in a different rotation position with respect to their drive shafts (30).

6 Claims, 3 Drawing Sheets

MULTIPOLE SWITCH WITH COMMON POLYPHASE OPERATING MECHANISM CHARACTERIZED BY STAGGERED CONNECTION OR DISCONNECTION

BACKGROUND OF THE INVENTION

1. Field of the Invention

The present invention relates to a multipole switch for medium voltage and high voltage.

2. Description of the Related Art

In order to keep the transients produced as a result of switching operations in medium-voltage and high-voltage networks as small as possible, switches are connected and/or disconnected such that they are synchronized in time with the network voltage or with the network current. An optimum reduction in the transients is achieved if, in the case of multipole switching, either all the poles are switched individually at different times or at least one pole is switched such that it is staggered in time with respect to the other poles, depending on the load to be switched. In a three-phase network, for example when connecting a capacitor bank, the transient currents are reduced most when the touching of the contacts in the individual poles in each case takes place at the time of the voltage zero crossing of the applied voltage. In this case, if both the star point of the supplying network and the star point of the capacitor bank are grounded, the three poles of the switch are closed, in a preferred manner, at intervals of in each case one sixth of a cycle, that is to say at an interval of 3 and ⅓ ms in a 50 Hz network. If, on the other hand, one of the star points is not grounded or is grounded only via a large impedance, two poles are preferably closed simultaneously first, and the third pole is closed with a delay of a quarter of a cycle, that is to say after 5 ms in a 50 Hz network. Optimum conditions for the suppression of transients during the connection of transformers and inductor coils can be achieved in an analogous manner if they are connected at the instant of the maximum value of the relevant phase voltage. Overvoltages can also be reduced in a corresponding manner during disconnection, by staggered switching of poles.

If each pole of a switch is driven by its own drive, the time stagger of the individual poles can be implemented in a simple manner by means of an electronic controller, for example a timing relay. However, if the individual poles of a switch are driven by a drive which is common to all the poles, the staggering of the poles must be implemented by the design of the mechanical transmission system for transmitting the switching movement from the drive to the moving switch contact pieces of the individual poles.

A switch of this type is disclosed in DE-A-3810453. Each pole has an interrupter unit whose moving switch contact piece is articulated, via an insulating rod, on a lug-like connecting element which is connected at the other end to a double-armed angled lever which can pivot about an axis. The double-armed angled levers are articulated on an operating rod which is common to all the poles and can be moved in a reciprocating manner by means of a drive. The staggering of the individual interrupter units is achieved in the case of this known switch by the angle of the toggle-lever joint between the respective connecting element and that arm of the double-armed angled lever which is connected to it in an articulated manner extending differently for the various poles. In this case, this different extent can be achieved by varied measures, such as different lengths of the connection elements and differently angled double-armed angled levers.

If this known transmission system is used in a switch in which one drive shaft per interrupter unit passes through a housing in a sealed manner, as is the case, for example, in the case of gas-blast switches which are insulated using SF6, the transmission linkage in the interior of the interrupter units must be designed. differently between the drive shaft and the moving switch contact piece in order to achieve identical connection and disconnection positions. However, the difference can be identified from the exterior only by suitable marking or by measurement, for example of the angle between the connected position and the separation of the contact pieces. There is therefore a risk of interrupter units being transposed during assembly and being assigned to incorrect. phases. Furthermore, a large number of different parts or adjustable parts are necessary, which leads to an increased supply-control and assembly cost.

A further power switch, which makes staggered switching possible, for high voltage is disclosed in EP-A-0541078. The switch has a single, continuous drive shaft which can be moved a reciprocating manner by means of the drive. A lever is assigned to each pole, which lever is arranged on this drive shaft in order to produce the staggering at a different rotation angle. In order to achieve identical connected and disconnected positions of the moving contacts and the same stroke in the interrupter units of all the poles, the levers and the insulating rods which connect the levers to the moving contact pieces must be designed to be of different length. Once again, the interrupter units of the switch differ from one another. In the case of a gas-insulated or liquid-insulated switch, in which the drive shaft is inserted into the poles in a sealed manner, this difference can, however, once again be detected from outside the interrupter units only by suitable marking or measurement. Once again, there is a risk of interrupter units being transposed during assembly, especially since, in order to implement four different switch variants, that is to say for 50 and 60 Hz and for staggered switching of all three poles or for time-delayed switching of one pole with respect to the two synchronously switching other poles, up to 10 variants of different interrupter units are required. In addition, the method of construction using a continuous drive shaft is unsuitable for relatively large switches, since such drive shafts do not have sufficient rotational stiffness and allow oscillations to start.

SUMMARY OF THE INVENTION

It is therefore an object of the present invention to develop a switch of the generic type in such a manner that the transposition of interrupter units during assembly is irrelevant and the switch can be implemented using a small number of different components.

The object is achieved by a switch of the generic type wherein the transmission linkages of all the interrupter units are of identical construction, the drive linkage has connecting rods arranged between the drive levers and the lever arms to the articulation points of at least one connecting rod and the associated drive levers have different rotation positions with respect to their drive shafts.

All the interrupter units in a switch comprise identical parts, only the drive levers possibly having to be of different design, it being possible even for the drive levers of at least two poles to be identical, unless they have to point in different directions in the connected position and/or disconnected position of the switch, which is made possible in a particularly simple manner, for example, by the use of toothed shafts. The transmission linkages, which connect the drive shafts to the moving switch contact pieces, of all the interrupter units are of identical design according to the invention. The risk of transposition which exists in the case of switches having interrupter units of different construction is avoided. Furthermore, according to the invention, the drive levers are connected to one another in an articulated manner via connecting rods.

The lever arms of all the drive levers are identical, in a preferred embodiment. If the switch according to the invention also has the features wherein the angle between a normal to a straight line which connects the axes of the drive shafts which are coupled to one another via a connecting rod and the lever arm to one articulation point of this connecting rod, in the connected position of the switch, corresponds to the negative corresponding angle of the lever arm to the other articulation point in the disconnected position of the switch, and vice versa, the same connected position, the same disconnected position and the same stroke of the switch contact pieces are achieved in all the interrupter units in a simple manner with lever arms of identical length.

A particularly preferred embodiment of the switch according to the invention is one wherein, on the drive shafts of all the interrupter units, identically constructed drive double levers, which have lever arms of equal length to the articulation points, point in the same direction as one another in the connected position and disconnected position and are arranged in the same rotation position with respect to their drive shafts, the drive double levers assume a position which is symmetrical with respect to the disconnected position in the connected position, with respect to a normal to a straight line which connects the axes of the drive shafts, and at least one connecting rod is articulated at different articulation points on the drive double levers connected by it. In the case of this embodiment, all the parts of all the interrupter units, including the position of the drive levers with respect to the shafts, may be of identical design. If all the interrupter units are to switch in a staggered manner, the connecting rods can furthermore also be of the same length.

BRIEF DESCRIPTION OF THE DRAWINGS

The present invention will now be explained in more detail with reference to two exemplary embodiments which are illustrated in the drawing and in which, purely schematically.

DESCRIPTION OF THE PREFERRED EMBODIMENTS

Figure 1:
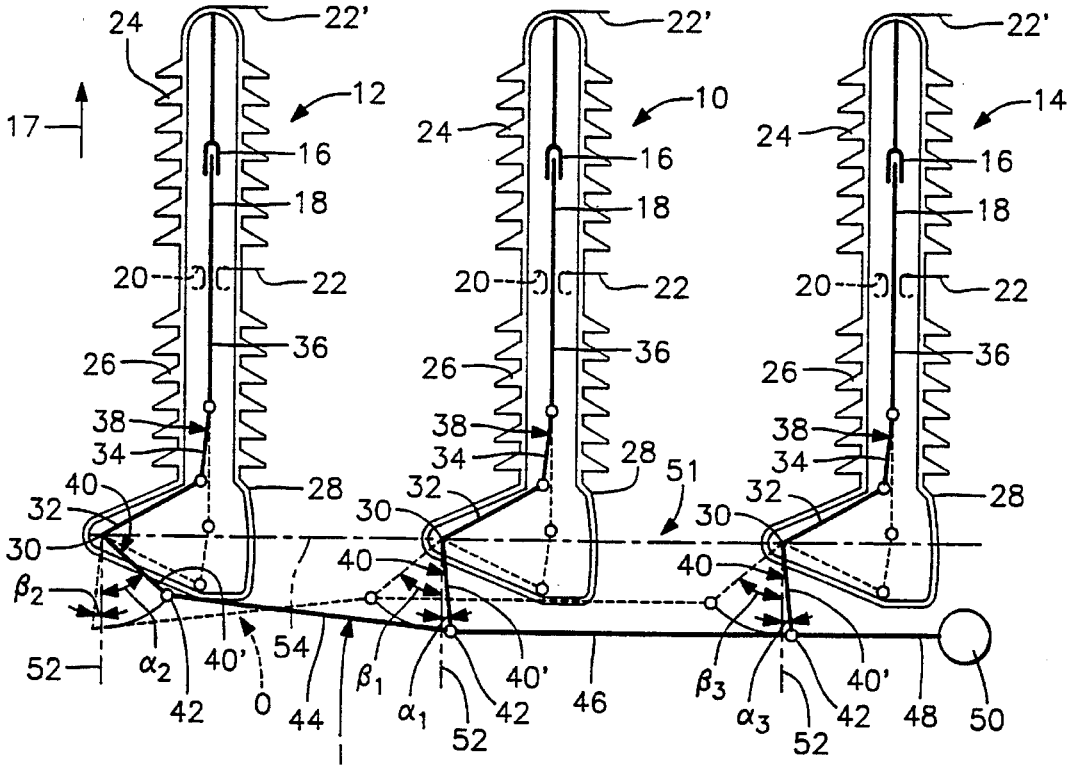
FIG. 1 shows a first embodiment of a three-pole switch having drive levers which are connected to one another via connecting rods, the drive lever of one interrupter unit being arranged with respect to the drive levers of the two other interrupter units in a different rotation position on the drive shaft.

FIG. 1 shows schematically the three interrupter units 10, 12, 14 of a three-pole medium-voltage or high-voltage switch. The interrupter units 10, 12, 14 each have a stationary switch contact piece 16 and a switch contact piece 18 which moves in the direction of the arrow 17 for connection and in the opposite direction for disconnection. This switch contact piece 18 interacts with a sliding contact piece 20 which is electrically conductively connected, in a known manner, to a first connecting flange 22. The stationary switch contact pieces 16 are likewise each electrically connected to a second connecting flange 22'. The switch contact pieces 16, 18 are each arranged in the interior of a switching chamber insulator 24 which is supported on a metallic mechanism housing 28 via a supporting insulator 26. Inserted into each mechanism housing 28 is a drive shaft 30 on which a transmission lever 32 is seated in a rotationally fixed manner in the interior of the mechanism housing 28, which transmission lever 32 is articulated via a lug-like connecting element 34 on an insulating rod 36 which is connected at the other end to the moving switch contact piece 18. The insulating rod 36 is guided such that it can be displaced in the movement direction 17 of the moving switch contact piece 18. The transmission lever 32, the connecting element 34 and the insulating rod 36 form a transmission linkage 38 in each interrupter unit 10, 12, 14. All the interrupter units 10, 12, 14, as well as the transmission linkage 38, are of identical design.

Seated on each drive shaft 30 outside the mechanism housing 28 is a drive lever 40 whose extent forms a lever arm 40' between the axis of the drive shaft 30 and an articulation point 42. A first connecting rod 44, which is articulated on the drive lever 40 of the interrupter unit 12 at the other end, and a second connecting rod 46, which is articulated on the drive lever 40 of the interrupter unit 14 at the other end, are articulated on the articulation point 42 of the drive lever 40 of the center interrupter unit 10. A drive connecting rod 48, which is connected to a schematically indicated drive 50 at the other end, furthermore acts on the articulation point 42 of the drive lever 40 of the interrupter unit 14. The connecting rods 44, 46 and the drive connecting rod 48 form a drive linkage 51.

The transmission linkage 38, the drive levers 40 and the first and second connecting rods 44, 46 are shown by solid lines in the connected position I and by dashed lines in the disconnected position O. As a result of the interrupter units 10, 12, 14 being of identical design, all the drive shafts 30 assume an identical rotation position in the connected position I. With respect to this rotation position of the drive shafts 30, the drive levers 40 of the interrupter units 10 and 14 are placed onto the associated drive shafts 30 pointing in the same direction, while in contrast the drive lever 40 of the interrupter unit 12 is in a different rotation position with respect to its drive shaft 30. In the connected position I, the lever arms 40' of the interrupter units 10 and 14 enclose identical angles $\alpha_1$, $\alpha_3$ with normals 52 to a straight line 54 which connects the axes of the drive shafts 30 to one another, which angles correspond to the negative angle $\beta_2$ between a normal 52 to the straight line 54 and the drive lever 40 in the disconnected position O. Likewise, the angles $\beta_1$ and $\beta_3$ between the normals 52 and the lever arms 40' of the interrupter units 10 and 12 when the switch is in the disconnected position O are equal to the negative angle $\alpha_2$ between a normal 52 and the lever arm 40' of the interrupter unit 12 when the switch is connected, the angles $\beta_1$ and $\beta_3$ being located on the same side with respect to the associated normals 52, but the angle $\alpha_2$ being located on the other side. If the lever arms 40' of all the drive levers 40 are of the same length, the moving switch contact pieces 18 of all the interrupter units 10, 12, 14 necessarily carry out during connection and disconnection, the moving switch contact piece 18 of the interrupter unit 12, however, lagging behind the moving switch contact pieces 18 of the other two interrupter units 10, 14 during connection, but leading them during disconnection. Furthermore, the moving switch contact pieces 18 of all the interrupter units 10, 12, 14 each assume the same position in the connected position I and the disconnected position O.

Figure 2:
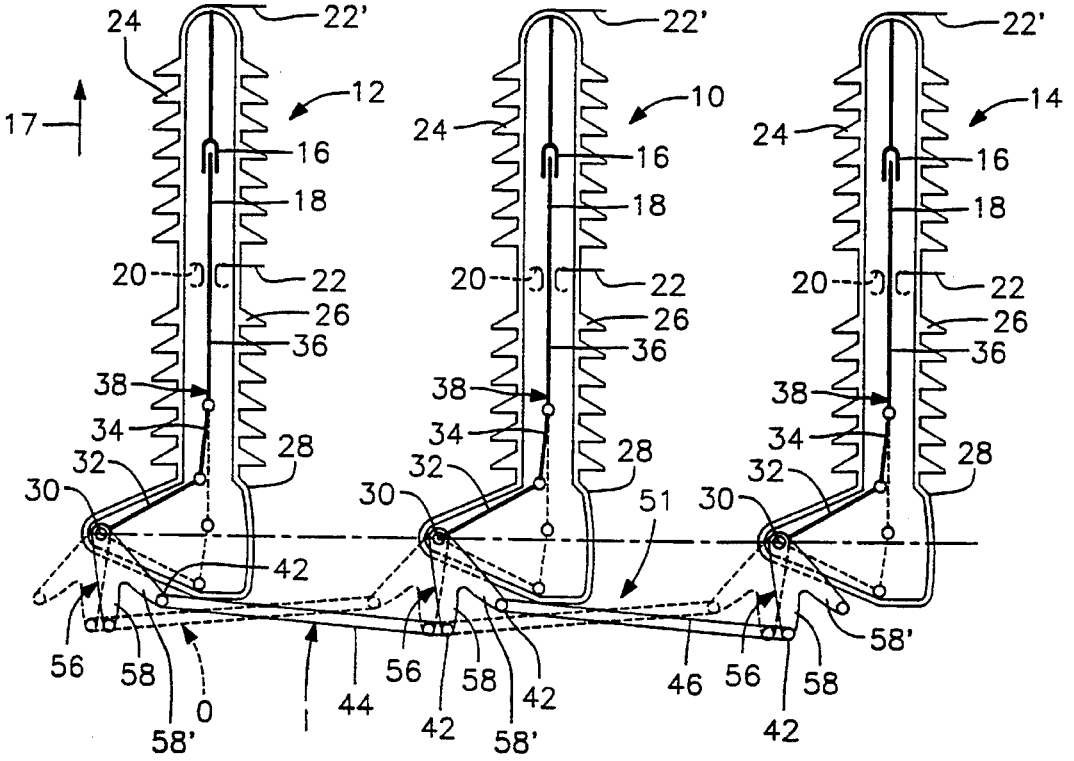
FIG. 2 shows a second embodiment of a three-pole switch according to the invention having double-armed drive levers which are arranged in the same rotation position with respect to the associated drive shafts and are connected to one another via connecting rods which act at different articulation points on the drive levers.
Figure 3:
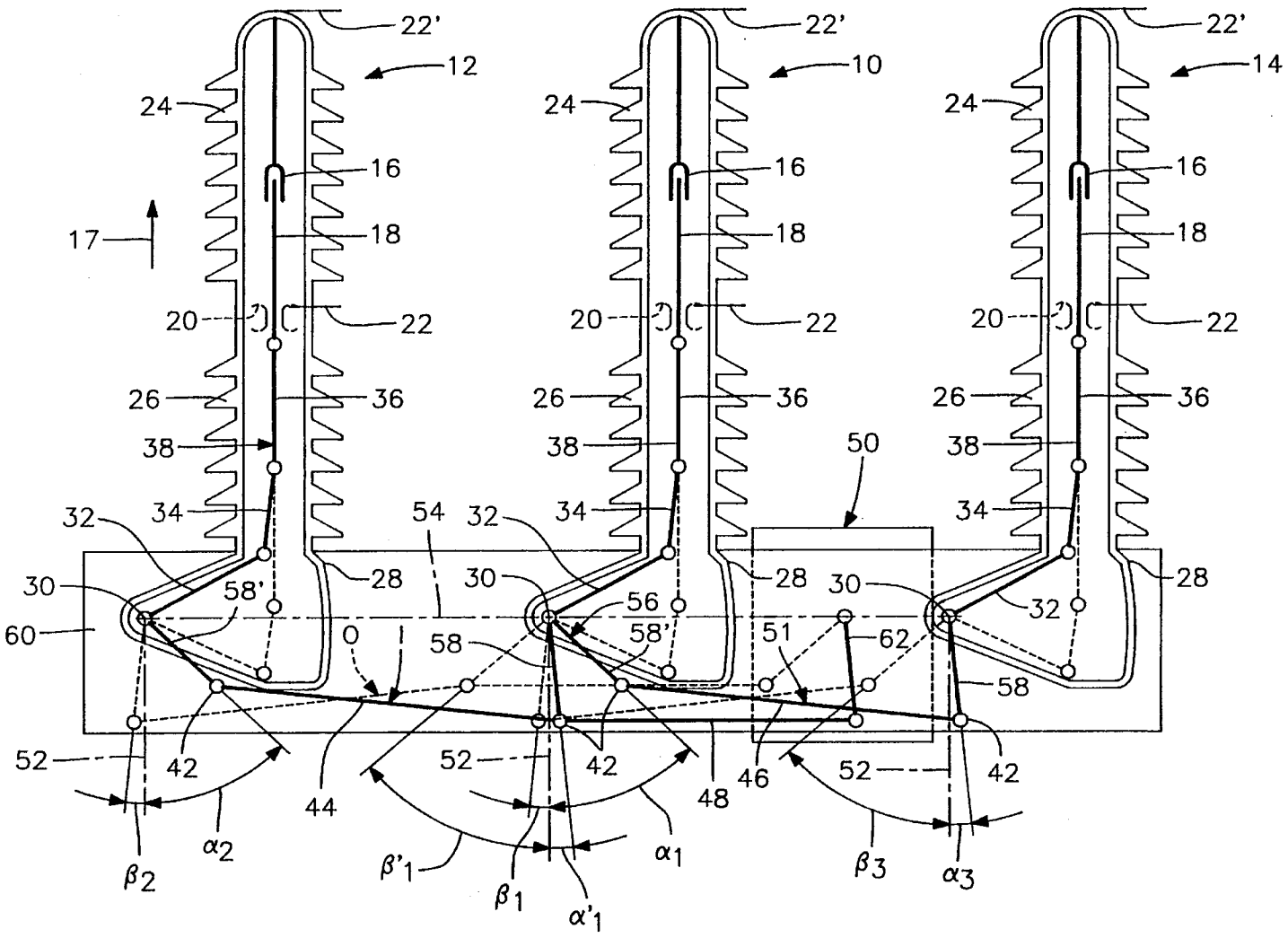
FIG. 3 shows the embodiment of the switch according to the invention, which is shown in FIG. 2, but enlarged here

In the case of the embodiment of the switch according to the invention shown in FIGS. 2 and 3, the interrupter units 10, 12, 14 are of precisely identical design, as in the case of the switch shown in FIG. 1. The same reference symbols are used for identical parts. For matters relating to the construction and method of operation of the interrupter units 10, 12, 14, reference is made expressly to FIG. 1. A drive double lever 56, having lever arms 58, 58' which are arranged in a V-shape with respect to one another, is seated in a rotationally fixed manner on the drive shaft 30 of each interrupter unit 10, 12, 14. These lever arms 58, 58' point in the same direction as one another in the connected position I of the switch, as is shown by solid lines, and they are arranged in the same rotation position with respect to the drive shafts 30. The same also applies, as is shown by dashed lines, in the disconnected position O of the switch. The lever arm 58 of the drive double lever 56 of the center interrupter unit 10 is connected via a first connecting rod 44 to the lever arm 58' of the drive double lever 56 of the interrupter unit 12, and the lever arm 58', which is assigned to the center interrupter unit 10, is connected via a second connecting rod 46 to the lever arm 58 of the drive double lever 56 of the interrupter unit 14. The drive double levers 56 of the two outer interrupter units 12, 14 could, of course, be replaced by single-armed drive levers, which correspond to the lever arms 58' and 58 respectively, as is shown schematically in FIG. 3.

As FIG. 3 furthermore shows, the interrupter units 10, 12, 14 are mounted by means of their mechanism housings 28 on a framework 60 on which the drive 50 is also arranged. The output-drive lever 62 of the drive 50 is connected in an articulated manner to the drive double lever 56 by means of the drive connecting rod 48 at the articulation point 42 of the lever arm 58 of the drive double lever 56 which is assigned to the center interrupter unit 10. The drive and transmission linkage 51, 38, which has the connecting rods 44, 46 and the drive connecting rods 48, can be moved by means of the drive 50 from the connected position I, which is illustrated by solid lines, into the disconnected position O, which is indicated by dashed lines, and back again. In the example shown, the rotation axis of the output-drive lever 62 intersects the straight line 54 which intersects the axes of the parallel drive shafts 30. Since the lever arm of the output-drive lever 62 is parallel to and of the same length as the lever arm 58 of the drive double lever 56 assigned to the center interrupter unit 12, these lever arms carry out the same pivoting movement during connection and disconnection.

The lever arm 58 of the interrupter unit 10 encloses an angle $\alpha_1'$ with a normal 52 to the straight line 54 in the connected position I, in the anticlockwise direction originating from the normal 52, and an angle $\beta_1'$, originating from the normal 52 in the clockwise direction, in the disconnected position O. The angle $\alpha_1$ is of equal size to this angle $\beta_1'$ but designates that position of the lever arm 58' in the connected position I pivoted in the anticlockwise direction with respect to the normal 52. In the disconnected position O, this lever arm 58' assumes a rotation position, with respect to the normal 52, which is displaced through the angle $\beta_1$ in the clockwise direction. Since the angle $\alpha_1$ corresponds to the angle $\beta_1'$ and the angle $\alpha_1'$ to the angle $\beta_1$, the drive double lever 56 assumes a position symmetrical with respect to the disconnected position O in the connected position I, with respect to the normal 52.

The length of the first connecting rod 44 is selected in such a manner that the lever arm 58' of the drive double lever 56 assigned to the interrupter unit 12 runs parallel and, with respect to the drive shafts 30, in the same direction as the lever arm 58' of the drive double lever 56 of the interrupter unit 10, in the connected position I of the switch. Since the lever arms 58, 58' of all the drive double levers 56 are of equal length, the lever arm 58' of the interrupter unit 12 assumes an angle position $\beta_2$, which is offset from the normal 52 in the clockwise direction, in the disconnected position O. This angle $\beta_2$ corresponds to the angle $\beta_1$ and to the negative angle $\alpha_1'$. In the same way, the angle $\alpha_2$ between the lever arm 58' and the normal 52 corresponds to the angle $\alpha_1$ and to the negative angle $\beta_1'$.

In the same manner, the length of the second connecting rod 46 is such that, in the connected position I, the lever 58 of the drive double lever 56 assigned to the interrupter unit 14 is arranged parallel to and pointing in the same direction as the drive shafts 30. The angle $\alpha_3$ in this case corresponds to the angle $\alpha_1'$ and to the negative angle $\beta_2$. In the same way, the angle $\beta_3$, which the lever arm 58 assumes with respect to the normal 52 in the disconnected position O, corresponds to the angle $\beta_1'$ and to the negative angle $\alpha_2$. With the same separation of the interrupter unit 10 from both the interrupter unit 12 and from the interrupter unit 14, the lengths of the first and second connecting rods 44 and 46 are equal, in contrast to the design according to FIG. 1.

Since, during switching, all the drive double levers 56 are pivoted through the same angle ($\alpha_1+\beta_1$; $\alpha_2+\beta_2$; $\alpha_3+\beta_3$) and the interrupter units 10, 12, 14 are of identical construction, all the moving switch contact pieces 18 carry out the same stroke and assume the corresponding, identical position in the connected position I as well as in the disconnected position O.

Figure 4:
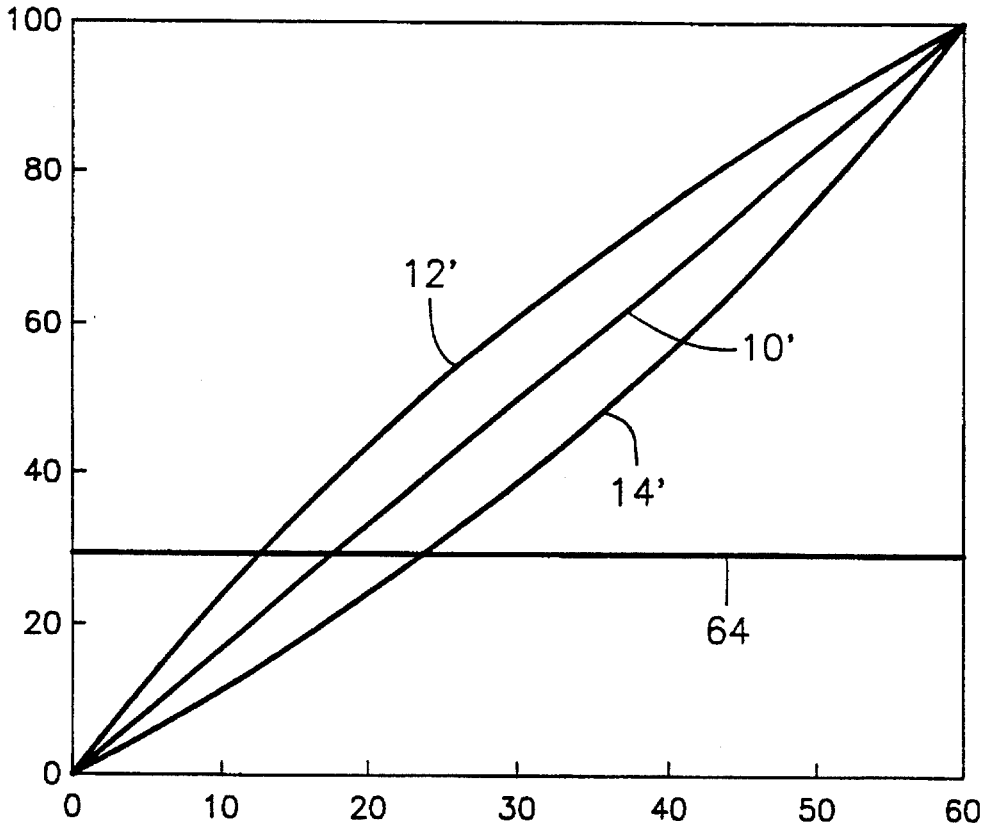
FIG. 4 shows a graphical illustration of the strokes of the moving switch contact pieces of the interrupter units of that switch which is shown in FIGS. 2 and 3 in operation of the rotation angle of the drive lever of the center pole.

FIG. 4 shows the stroke of the moving switch contact pieces 18 of the interrupter units 10, 12, 14 of the switch which is shown in FIGS. 2 and 3, as a function of the rotation angle of the drive double lever 56 of the center interrupter unit 12. On the abscissa axis, "0" corresponds to the connected position I and "60" corresponds to the disconnected position O of this drive double lever 56, angular degrees being shown increasing in the clockwise direction. On the ordinate axis, the stroke is indicated as a percentage, "0" corresponding to the connected position I and "100" corresponding to the disconnected position O. The parallel 64 to the abscissa axis symbolizes the stroke during which the stationary and moving switch contact pieces 16, 18 are separated from one another during disconnection and touch during connection. As the intersections of the curves 10', 12', 14', which correspond to the stroke of the moving switch contact pieces 18 of the interrupter units 10, 12, 14, with the parallel 64 show, the moving switch contact pieces 18 of the interrupter units 12 and 14 lead that of the interrupter unit 10 during disconnection and, in the reverse manner, lag behind it during connection. Furthermore, the curves 10', 12', 14' merge at a point in the connected position I and disconnected position O. This means that all the moving switch contact pieces 18 each assume the same position in the connected position I and in the disconnected position O.

It would, of course, also be conceivable in the case of a switch according to FIGS. 2 and 3 for the first or second connecting rod 44, 46 in each case to be articulated on the same lever arms 58 or 58' of the two corresponding drive double levers 56. This results in two interrupter units 10 and 12 or 10 and 14 switching simultaneously and switching in a staggered manner with respect to the other interrupter unit 14 or 12, respectively, in each case. Depending on which connecting rod 44, 46 is articulated in this manner, the two synchronized interrupter units lead or lag the other during connection. The length of the relevant connecting rod 44, 46 must, of course, be adapted such that the drive double levers 56 point in the same direction in the connected position I and the disconnected position O.

It is also conceivable in the case of an embodiment which is equivalent to FIGS. 2 and 3 for the drive double lever 56 of the interrupter unit 10 to be replaced by two individual drive levers which are fitted onto the drive shaft 30 in a correspondingly different rotation position. The same single-armed drive levers can then be used for the two other interrupter units 12 and 14. The drive shafts 30 preferably have a suitable tooth system for fitting the drive levers onto them in a different rotation position.

In the exemplary embodiments shown, each interrupter unit 10, 12, 14 has an interruption point which is shown by the switch contact pieces 16, 18. It is, of course, also possible to provide a plurality of interruption points per interrupter unit.

I claim:

1. A multipole switch for medium voltage and high voltage having one interrupter unit per pole, each interrupter unit having a drive shaft, said drive shafts being arranged in parallel relation, a moving switch contact piece and a transmission linkage connecting said switch contact piece to the drive shaft, each interrupter unit having a drive lever seated in a rotationally fixed manner on the parallel-arranged drive shafts, said drive levers being connected by a drive linkage to a drive which is common to all the interrupter units, wherein the transmission linkages of all the interrupter units are of identical construction, said drive linkage including connecting rods directly connected to the drive levers at an articulation point to form a lever arm between the drive shafts and articulation points, the lever arm to the articulation point of at least one connecting rod and the associated drive lever having a different rotation position with respect to the drive shaft.

2. The switch as claimed in claim 1, wherein the lever arms to all the articulation points between the connecting rods and drive levers are of the same length.

3. The switch as claimed in claim 1, wherein the angle between a normal to a straight line which connects the axes of the drive shafts which are coupled to one another via a connecting rod and the lever arm to one articulation point of this connecting rod, in the connected position of the switch, corresponds to the negative corresponding angle of the lever arm to the other articulation point in the disconnected position of the switch, and vice versa.

4. The switch as claimed in one of claim 1, wherein, on the drive shafts of all the interrupter units, identically constructed drive double levers, which have lever arms of equal length to the articulation points, point in the same direction as one another in the connected position and disconnected position and are arranged in the same rotation position with respect to their drive shafts, the drive double levers assume a position which is symmetrical with respect to the disconnected position in the connected position, with respect to a normal to a straight line which connects the axes of the drive shafts, and at least one connecting rod is articulated at different articulation points on the drive double levers connected by it.

5. The switch as claimed in claim 2, wherein the angle between a normal to a straight line which connects the axes of the drive shafts which are coupled to one another via a connecting rod and the lever arm to one articulation point of this connecting rod, in the connected position of the switch, corresponds to the negative corresponding angle of the lever arm to the other articulation point in the disconnected position of the switch, and vice versa.

6. A multipole switch having one interrupter unit per pole, said interrupter units being of identical construction, each interrupter unit comprising an insulated switching chamber, a stationary switch contact piece and a movable contact piece in said chamber, a transmission linkage conducted with said movable switch contact piece, said chamber including a housing at one end thereof, a drive shaft mounted in said housing, said transmission linkage being connected to said drive shaft to move said movable switch contact piece in response to rotational movement of said drive shaft, a drive lever affixed to and extending laterally from said drive shaft, the drive levers connected to the drive shafts being of the same length to form equal length lever arms extending from said drive shafts, a connecting rod assembly directly connected to each of said drive levers at an articulation point and a drive unit connected to said connecting rod assembly to simultaneously pivot all of said drive levers through an equal angle of pivotal movement, at least one of said drive levers being affixed to its associated drive shaft at a fixed angular relation different from the fixed angular relation between the other drive levers and their associated drive shafts whereby the movable switch contact piece connected to the drive shaft having the differently angled drive lever connected thereto will move in a pattern different from the other movable switch contact pieces during movement of the connecting rod assembly for connecting and disconnecting the switch contact pieces associated with the transmission linkage connected to the drive shaft having the differently angled drive lever at a different time than the other switch contact pieces.

* * * * *